US005356103A

United States Patent [19]

McClurg

[11] Patent Number: 5,356,103

[45] Date of Patent: Oct. 18, 1994

[54] APPARATUS FOR PROVIDING SUPPORT ON A METAL PURLING

[76] Inventor: Donald L. McClurg, 6000 Oriole Dr., Midland, Tex. 79707

[21] Appl. No.: 129,768

[22] Filed: Sep. 30, 1993

[51] Int. Cl.[5] ..... A47B 96/06

[52] U.S. Cl. ..... 248/220.2; 211/90; 248/225.1; 248/247; 248/249

[58] Field of Search ..... 248/220.2, 225.1, 223.3, 248/222.3, 231.8, 247, 248, 249; 211/90; 52/36.5, 36.6

[56] References Cited

U.S. PATENT DOCUMENTS

| | | | |
|---|---|---|---|
| 2,459,692 | 1/1949 | Fletcher | 248/916 X |
| 3,265,217 | 8/1966 | Biggs | 211/90 |
| 3,279,620 | 10/1966 | Nesbitt | 211/87 |
| 3,648,419 | 3/1972 | Marks | 52/36 |
| 4,205,815 | 6/1980 | Sauer et al. | 248/243 |
| 4,313,587 | 2/1982 | Loeschen | 248/217.2 |
| 4,443,979 | 4/1984 | Varon et al. | 52/36 |
| 4,450,970 | 5/1984 | Shepherd | 52/36.5 |
| 4,467,925 | 8/1984 | Ratzloff et al. | 211/60 T |
| 4,568,212 | 2/1986 | Cooke | 248/225.1 X |
| 4,678,151 | 7/1987 | Radek | 248/220.2 |
| 4,678,152 | 7/1987 | Cheng | 248/225.1 |
| 4,785,946 | 11/1988 | Sorensen | 248/225.1 X |
| 4,787,587 | 11/1988 | Deming | 248/205.1 |
| 4,790,505 | 12/1988 | Rose et al. | 248/205.1 |
| 4,809,941 | 3/1989 | Sheridan | 248/249 |
| 4,817,900 | 4/1989 | Whittington | 211/88 X |
| 4,846,354 | 7/1989 | Adams | 248/222.3 X |
| 4,961,295 | 10/1990 | Kosch | 52/36.5 |
| 4,971,280 | 11/1990 | Rinderer | 248/229 |
| 5,004,199 | 4/1991 | Suk | 248/231.8 |
| 5,228,579 | 7/1993 | Kaufman | 52/36.5 X |

FOREIGN PATENT DOCUMENTS

| | | | |
|---|---|---|---|
| 1388576 | 12/1964 | France | 248/249 |
| 2636654 | 3/1990 | France | 52/36.5 |

*Primary Examiner*—J. Franklin Foss
*Attorney, Agent, or Firm*—Baker & Botts

[57] ABSTRACT

A bracket member (30) includes a first section (32) that is form fitted to a metal purling (14). The bracket member (30) also includes a second section (34) that extends from the first section (32) and away from the metal purling (14) in order to install a shelf or other bracket structures to the bracket member (30) and not to the metal purling (14). The first section (32) has a raised flange at one end of the bracket member (30). The second section (34) has an aperture (38) at the other end of the bracket member (30) for receiving the flange (36) in order to snap into place the first section (32) and the second section (34). With the second section (34) secured to the first section (32) at the flange (36) and the aperture (38), the bracket member (30) is securely held in place at the metal purling (14) to support additional structures.

17 Claims, 2 Drawing Sheets

APPARATUS FOR PROVIDING SUPPORT ON A METAL PURLING

TECHNICAL FIELD OF THE INVENTION

The present invention relates in general to building construction techniques and more particularly to an apparatus for providing support on a metal purling.

BACKGROUND OF THE INVENTION

In metal building construction, horizontal metal purlings are used to support a building structure. Conventional bracket structures used in supporting shelves, appliances, or other bracket structures require multiple fasteners for attachment to the metal purling. Many of these bracket structures are not uniquely adapted for metal purling use. Therefore, it is desirable to have a bracket structure specifically adapted to a metal purling with minimum effect on structural integrity.

From the foregoing, it may be appreciated that a need has arisen for a bracket structure adaptable for use with a metal purling. A need has also arisen for a bracket structure that can easily secure to the metal purling.

SUMMARY OF THE INVENTION

In accordance with the present invention, an apparatus for providing support on a metal purling is provided that substantially eliminates and reduces disadvantages and problems associated with conventional bracket structures.

According to an embodiment of the present invention, there is provided an apparatus for providing support on a metal purling that includes a bracket member having a first section form fitted to the metal purling. The bracket member also has a second section extending from the first section and away from the metal purling at two different locations on the metal purling in order to support shelves or other bracket structures directly on the bracket member and not on the metal purling.

The apparatus of the present invention provides for various technical advantages. For example, one technical advantage is in having a bracket member that can be easily installed onto a metal purling. Another technical advantage is in having a bracket member that is form fitted to the metal purling such that the bracket member is firmly secured to the metal purling. Yet another technical advantage is in having a bracket member that firmly secures to the metal purling without fastening the bracket member to the metal purling. Other technical advantages are readily apparent to one skilled in the art from the following figures, descriptions, and claims.

BRIEF DESCRIPTION OF THE DRAWINGS

For a more complete understanding of the present invention and the advantages thereof, reference is now made to the following description taken in conjunction with the accompanying drawings, wherein like reference numerals represent like parts, in which.

DETAILED DESCRIPTION OF THE INVENTION

Figure 1:
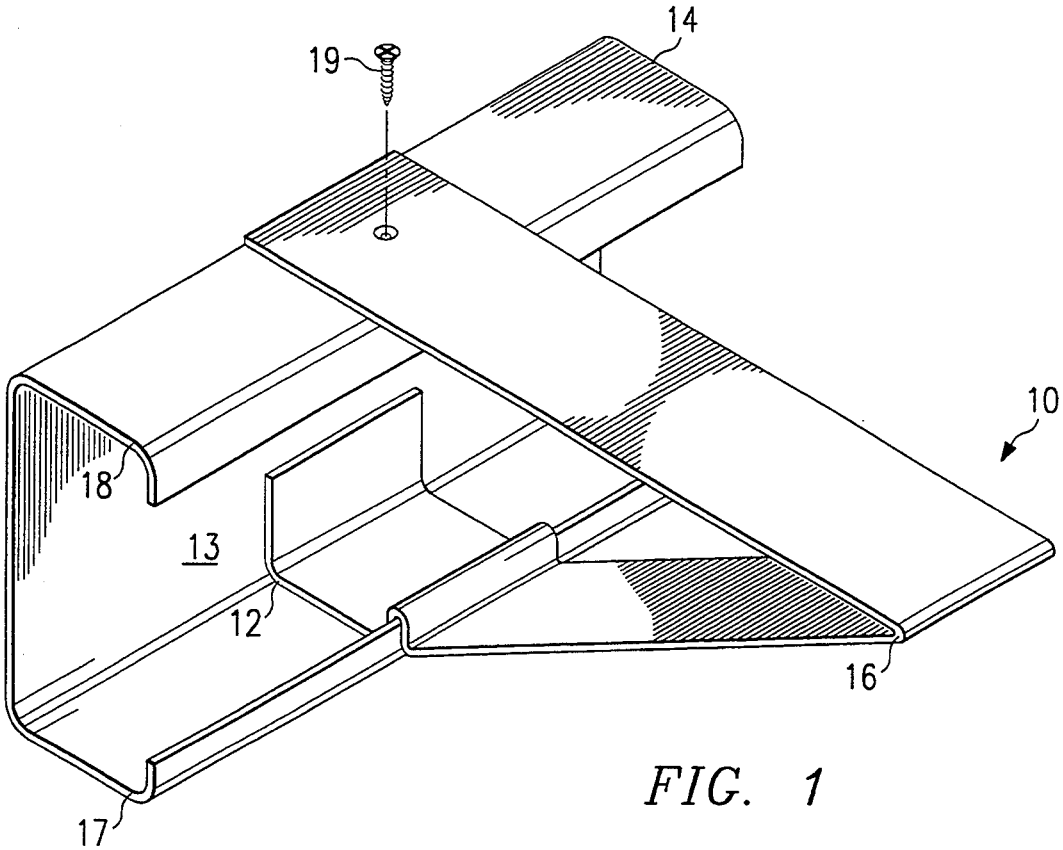
FIG. 1 illustrates a diagram of a bracket member fastened to a metal purling.

FIG. 1 is a sectional diagram of a bracket member 10. Bracket member 10 has a first section 12 that is form fitted to an interior surface 13 of a metal purling 14 at a lower portion 17. Bracket member 10 also has a second section 16 that extends from first section 12 at lower portion 17 of metal purling 14 and is fastened to an upper portion 18 of metal purling 14 by a fastener 19. Second section 16 of bracket member 10 extends away from lower portion 17 and upper portion 18 of metal purling 14 such that a shelf or other bracket structures can be installed on bracket member 10 and not on metal purling 14.

Figure 2:
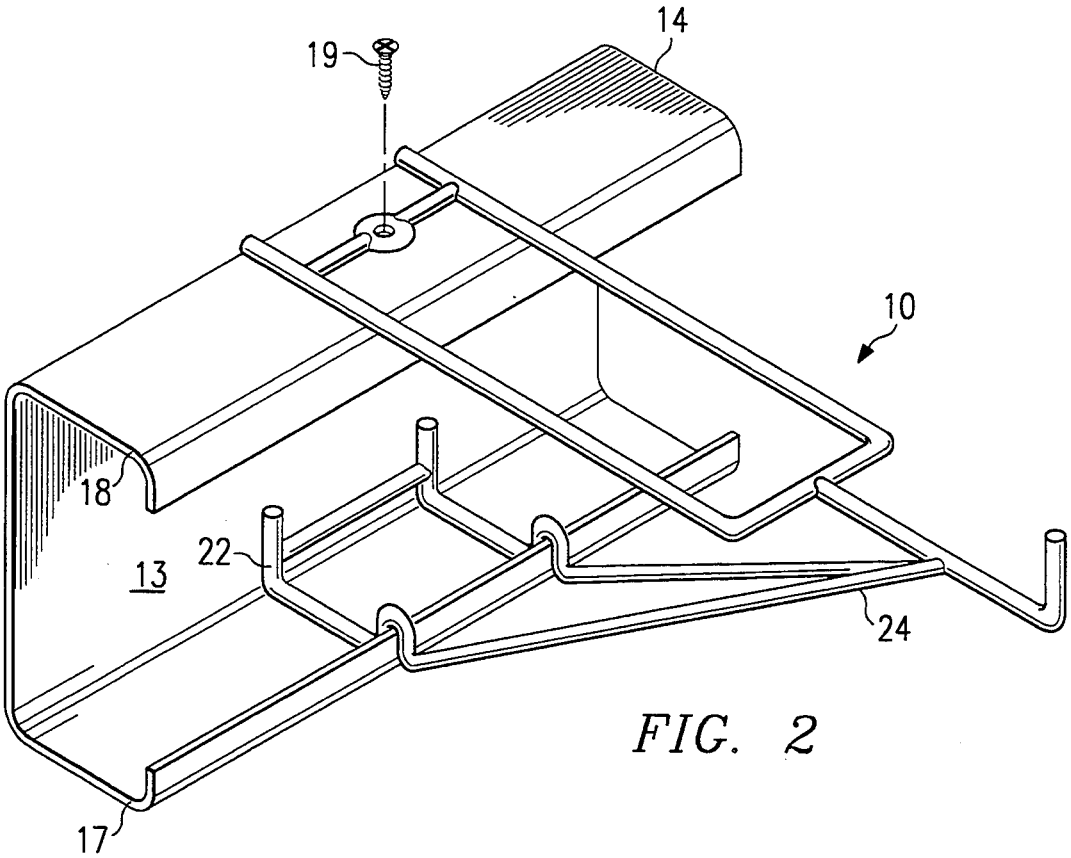
FIG. 2 illustrates a diagram of a bracket member made from wire stock.

FIG. 2 is a sectional diagram of a bracket member 20 in an alternative embodiment. In this embodiment, bracket member 10 is made from wire stock instead of plate stock as shown in FIG. 1. Bracket member 10 of FIG. 2 has a first end 22 form fitted to interior surface 13 of metal purling 14 at lower portion 17. A second section 24 extends from first section 22 at lower portion 17 of metal purling 14 and is attached by a fastener 19 to upper portion 18 of metal purling 14.

Figure 3A:
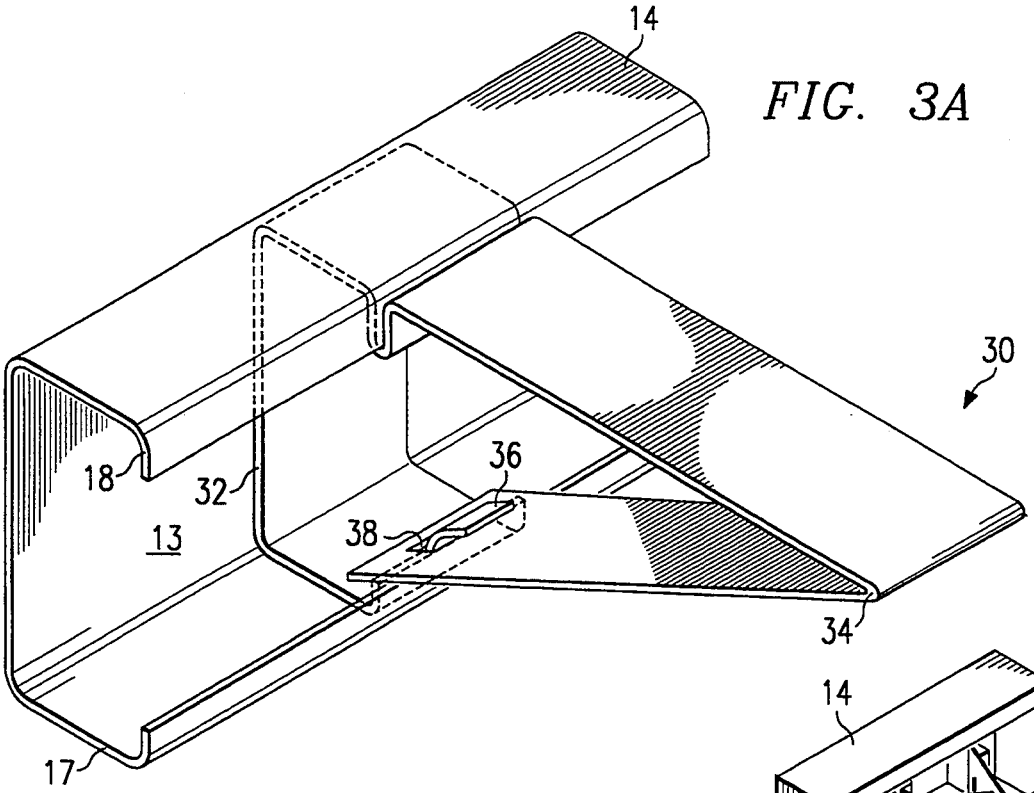
FIGS. 3A–B illustrate a diagram of a bracket member securely fitted to an interior of the metal purling.
Figure 3B:
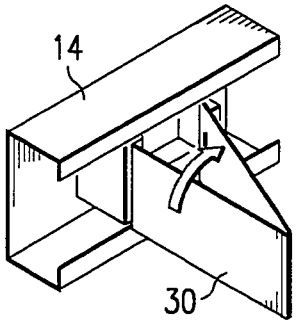

FIGS. 3A–B are sectional diagrams of a bracket member 30 in an alternative embodiment. In FIG. 3A, bracket member 30 has a first section 32 that is form fitted entirely to interior surface 13 of metal purling 14. First section 32 abuts against interior surface 13 of metal purling 14. Bracket member 30 also has a second section 34 that extends from first section 32 at lower portion 17 and at upper portion 18 of metal purling 14. Bracket member 30 is formed such that first section 32 adjoins and is contiguously attached with second section 34 at upper portion 18 of metal purling 14. At lower portion 17 of metal purling 14, first section 32 has a raised flange 36 at one end of bracket member 30. At the other end of bracket member 30, second section 34 has an aperture 38 that receives flange 36 to snap into place first section 32 and second section 34 at lower portion 17 of metal purling 14. With first section 32 form fitted to interior surface 13 of metal purling 14 and second section 34 snapped into place at flange 36, bracket member 30 securely mounts and is supported by metal purling 14 without any extraneous fasteners. Bracket member 30 is now capable of supporting a shelf or other bracket structures as desired.

FIG. 3B shows how bracket member 30 is installed into metal purling 14. Bracket member 30 is inserted within metal purling 14 and rotated into the position shown in FIG. 3A. With such an installation, bracket member 30 may be constructed as a continuous piece, having ridges aligned with and configured to fit around the edges of upper portion 18 and lower portion 17 of metal purling 14, as shown in FIG. 3B and simply twist into place for use without the snap-in feature described above.

Figure 4:
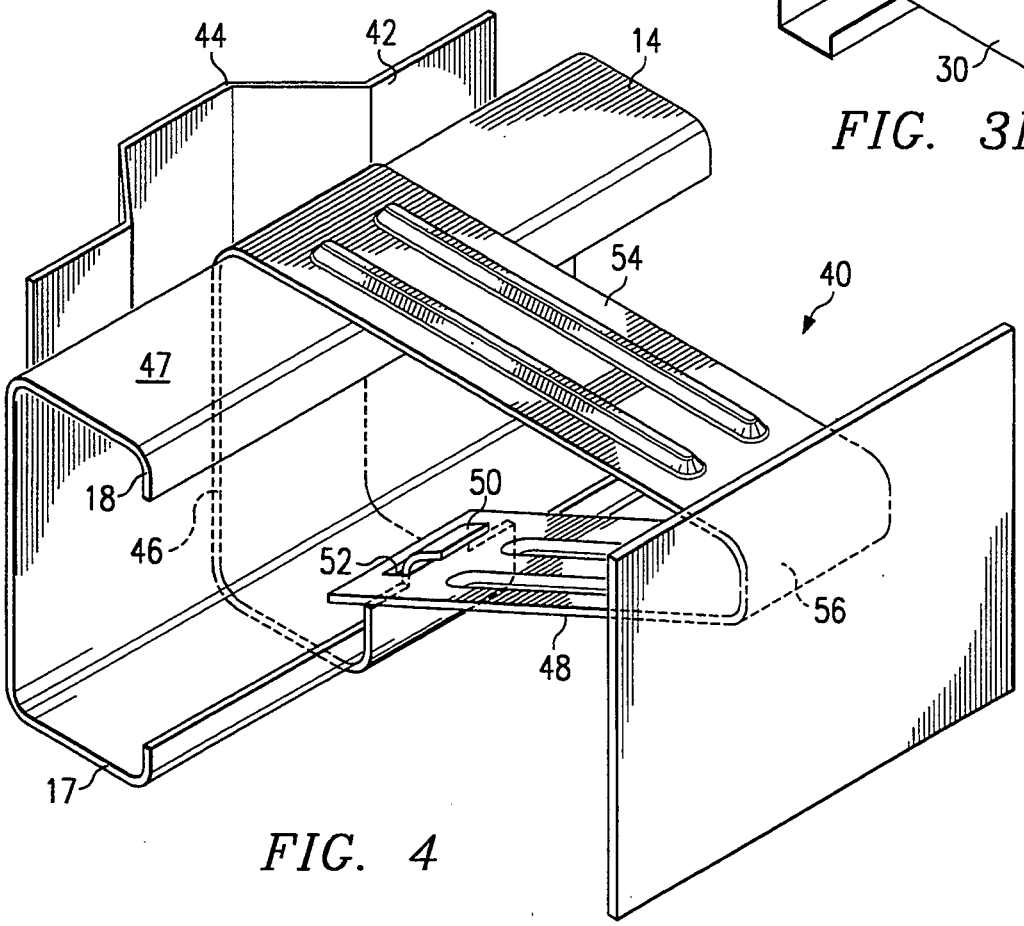
FIG. 4 illustrates a diagram of a bracket member securely fitting around an exterior of the metal purling.

FIG. 4 is a sectional diagram of a bracket member 40 illustrating another alternative embodiment. Bracket member 40 is for use on a metal purling 14 that is attached to a sheet metal wall 42 having corrugations 44. In this embodiment, bracket member 40 has a first section 46 that is form fitted entirely around an exterior surface 47 of metal purling 14. First section 46 abuts against and surrounds exterior surface 47 of metal purling 14 within corrugation 44 of sheet metal wall 42. A second section 48 is adjoined to and contiguous with first section 46 at upper portion 18 of metal purling 14.

First section 46 has a raised flange 50 and second section 48 has an aperture 52 that snap together at lower portion 17 of metal purling 14, in a similar manner as described with bracket member 30 of FIG. 3, to secure bracket member 40 to metal purling 14. Bracket member 40 has a horizontal surface 54 and a vertical surface 56 for installation of shelf or other bracket structures as desired.

Bracket member 40, or any of the other alternative embodiments, may be constructed of plate or rod steel and may be corrugated, similarly as sheet metal wall 42, to increase strength and stiffness of bracket member 40. For lightweight duty applications, bracket member 40 may be constructed of plastic or other materials with suitable load bearing characteristics.

In summary, a bracket member has a first section form fitted to a metal purling. A second section of the bracket member extends from the first section and away from the metal purling to allow for installation of shelving or other bracket structures on the bracket member and not on the metal purling. The bracket member can be fastened to the metal purling or the two ends of the bracket member can snap together, firmly securing the bracket member to the metal purling without the need of a fastener.

Thus, it is apparent that there has been provided, in accordance with the present invention, an apparatus for providing support on a metal purling that satisfies the advantages set forth above. Although the preferred embodiment has been described in detail, it should be understood that various changes, substitutions, and alterations can be made herein without departing from the spirit and scope of the present invention as defined by the following claims.

What is claimed is:

1. An apparatus for providing support on a metal purling, comprising:

a bracket member, said bracket member having a first section for contact with a first portion of the metal purling, said bracket member having a second section for contact with a second portion of the metal purling, said bracket member extending from said first and second sections and away from said first and second portions of the metal purling, said second portion being opposite said first portion.

2. The apparatus of claim 1, wherein said first and second sections are formed to contact an exterior surface of the metal purling.

3. The apparatus of claim 1, wherein said first and second sections are formed to contact an interior surface of the metal purling.

4. The apparatus of claim 1, wherein said second section is fastened to the metal purling.

5. The apparatus of claim 1, wherein said first section has a first end and a second end, said first end of said first section having a raised flange, said second section having a first end and a second end, said second end of said first section being contiguous with said second end of said second section, said first end of said second section having an aperture therethrough to accept said raised flange of said first end of said first section in order to hold said bracket member in place on the metal purling.

6. The apparatus of claim 1, wherein said bracket member forms substantially a right triangle on the metal purling.

7. The apparatus of claim 1, wherein said bracket member is made of wire stock.

8. The apparatus of claim 1, wherein said bracket member is corrugated for increased stiffness and support.

9. An apparatus for providing support on a metal purling, comprising:

a bracket member, said bracket member being form fitted to the metal purling, said bracket member having a first end and a second end, said first end having a flange, said second end having an aperture for receiving said flange in order to firmly secure said bracket member to the metal purling.

10. The apparatus of claim 9, wherein said bracket member is form fitted within an interior of the metal purling.

11. The apparatus of claim 9, wherein said bracket member is form fitted around an exterior of the metal purling.

12. The apparatus of claim 9, wherein said bracket member extends away from the metal purling to form a substantially right triangular shape.

13. An apparatus for providing support on a metal purling, comprising:

a bracket member, said bracket member having a first section formed to abut against a surface section of the metal purling and a second section, said first section having a first end, said first end having a flange, said first section having a second end contiguously attached with a first end of said second section, said second section having a second end with an aperture therethrough for receiving said flange to secure said bracket member to the metal purling.

14. The apparatus of claim 13, wherein said second section extends away from the metal purling at said second end of said first section and at said flange to form a substantially right triangular shape.

15. The apparatus of claim 13, wherein said first section abuts against an interior surface section of the metal purling.

16. The apparatus of claim 13, wherein said first section abuts against an exterior surface section of the metal purling.

17. The apparatus of claim 1, wherein said bracket member is in one contiguously enclosed piece.

* * * * *